US005265755A

United States Patent [19]

McArthur, Jr. et al.

[11] Patent Number: 5,265,755

[45] Date of Patent: Nov. 30, 1993

[54] TRASH RECEPTACLE WITH OPEN VENTED MEANS

[76] Inventors: Daniel L. McArthur, Jr., P.O. Box 190, Pinehurst, N.C. 28374; Douglas R. McArthur, 501 Colony Woods Dr., Chapel Hill, N.C. 27514

[21] Appl. No.: 941,797

[22] Filed: Sep. 8, 1992

[51] Int. Cl.[5] ..... B65D 90/34

[52] U.S. Cl. ..... 220/601; 220/913; 220/908; 220/404; 220/403; 210/369; 210/373; 210/374

[58] Field of Search ..... 220/914, 908, 403, 404, 220/601, 367, 373, 369, 374; 248/95

[56] References Cited

U.S. PATENT DOCUMENTS

| | | | |
|---|---|---|---|
| 545,662 | 9/1895 | Stewart . | |
| 1,613,621 | 1/1927 | Oke . | |
| 1,736,192 | 11/1929 | Easton . | |
| 2,533,524 | 12/1950 | Snider . | |
| 2,678,764 | 5/1954 | Carlson . | |
| 3,074,583 | 1/1963 | Martinich . | |
| 3,342,368 | 9/1967 | Matry . | |
| 3,815,778 | 6/1974 | Martin . | |
| 4,054,225 | 10/1977 | Frech . | |
| 4,294,379 | 10/1981 | Bard . | |
| 4,459,793 | 7/1984 | Zenger | 270/404 X |
| 4,715,572 | 10/1987 | Robbins et al. | 220/404 |
| 4,890,760 | 1/1990 | Nicoll, Sr. et al. . | |
| 5,031,796 | 6/1991 | Schäfer et al. | 220/571 |
| 5,036,999 | 8/1991 | Bitsch . | |
| 5,065,891 | 11/1991 | Casey . | |
| 5,909,585 | 2/1992 | Power . | |

*Primary Examiner*—Allan M. Shoap
*Assistant Examiner*—Paul A. Schwarz

[57] ABSTRACT

A trash receptacle including a vent means mounted in the bottom therefore for eliminating the formation of a vacuum when a filled flexible trash bag liner is removed from the receptacle. The air vent holes are placed superiorly in a central vertical stalk. The base has one or more air channels that allow air ingress and egress from the outside atmosphere to the raised central stalk area. The central vertical vent stalk has a dome shaped roof with an overhang to channel spilled liquids away from the air vent holes onto a sloping floor which in turn diverts the liquid to the outer corners of the inner receptacle base.

5 Claims, 2 Drawing Sheets

TRASH RECEPTACLE WITH OPEN VENTED MEANS

FIELD AND BACKGROUND OF THE INVENTION

This invention is in the field of trash receptacles, and its features negate the need for vacuum release for removal of a filled flexible bag liner.

Considerable effort is often required to remove filled trash bag liners from non-vented conventional trash receptacles. Some of this resistance is caused by the effects of friction between the inner side wall surface of the container and the outer surface of the flexible bag liner. In a non-vented receptacle, most of the resistance to removal is undoubtedly attributable to negative atmospheric pressure or vacuum which results from the well adapted bag liner sealing to the rigid container inner side walls and inner base.

A simple, but flawed solution to the problem of difficult bag liner removal is a hole in the base of the rigid container. The problem with this configuration lies in its basic failure to contain spilled liquids which collect in its base.

There have been a number of vented trash containers patented over the years. Some of these predate the use of the flexible bag liners as they are currently used and the venting served other purposes. Some of these patents are U.S. Pat. Nos. 545,662; 1,613,621; 1,736,192; 2,533,524; 3,074,583; 3,342,368; 5,031,796 and 5,036,999.

It is interesting to note that the U.S. Pat. No. 3,342,368 issued to Matry in 1967 outlined a container that is similar in configuration, but different in purpose, to our proposed container. His container had a sloping floor and vents for liquid drainage.

Several inventors have described vented containers as an aid to bag liner placement rather than bag liner removal. Some of these are shown in U.S. Pat. No. 2,678,764; 3,815,778; 5,065,891.

In 1977 Frech with U.S. Pat. No. 4,054,225 had a unique solution to the problem of bag liner removal from a rigid container. He suggested a receptacle that could be opened along slits in its side wall.

In recent years several people have spoken more directly to the issue of vacuum release and bag liner separation. In 1981 Bard with U.S. Pat. No. 4,294,379 described a rigid container with hollow tubes in the side wall. The patent states that the tubes could be molded in place when the container was manufactured or they could be added with adhesive as a secondary procedure. It would be difficult and therefore expensive to mold the tubes inplace. It would be somewhat expensive to add the tubes as a secondary item.

Robbins, III et al. in 1987 with U.S. Pat. No. 4,715,572 suggested a device for retaining the trash bag liner in place as well as offering ventilation for bag removal. The device has several separate components and it is bordering on being complicated.

In 1990 Nicoll, Sr. et al. with U.S. Pat. No. 4,890,760 described a container with sophisticated mushroom shaped valve and flexible circular diaphragm. This device has several possible drawbacks. Any system that uses force activated valving requires an initial force to activate the valving. A system like ours with open vents and no moving parts requires no initial force of activation. The net effect is that more force is required for bag removal from a container that has venting via moving parts than a container that has venting by an open, non movable means. Another concern is the proper and effective sealing of the flexible diaphragm to prevent the escape of spilled liquids from the rigid receptacle. Yet another concern relates to the sophisticated nature of the entire venting mechanism and the cost associated with its manufacturer.

In 1992 Power with U.S. Pat. No. 5,909,585 shows a very complicated container with a flapper valve to vent air for bag removal. The valve also allowed for insertion of a replacement bag liner from a compartment below the flapper valve. We question the economic viability and practical application of this receptacle.

OBJECTS AND ADVANTAGES OF THE INVENTION

The main object of this invention is to provide a venting means in a rigid container to facilitate the removal of a filled flexible bag liner.

An additional object of this invention is that the venting be simple with no moving parts The cost of manufacturing should approximate the cost for conventional receptacles of similar size and shape.

An additional object of this invention is that the venting means would facilitate flexible bag liner placement as well as bag removal from the host container.

Yet another object of this invention is that the essentially rigid container be manufactured from suitable material to minimize the effects of surface tension, adhesion, and cohesion between the flexible bag liner and the rigid container side walls and base.

In summary the main object of this invention is to provide a trash receptacle that permits a venting means when a well adapted, filled trash bag liner is removed from the more rigid host container. The container should be simple in configuration, economical to manufacture, and practical to use. Still further objects and advantages will become apparent from consideration of the ensuing description and drawings. –

BRIEF DESCRIPTION OF THE DRAWINGS

The preferred embodiment of the invention is illustrated in the included drawings.

LIST OF REFERENCE NUMBERS

Figure 1:
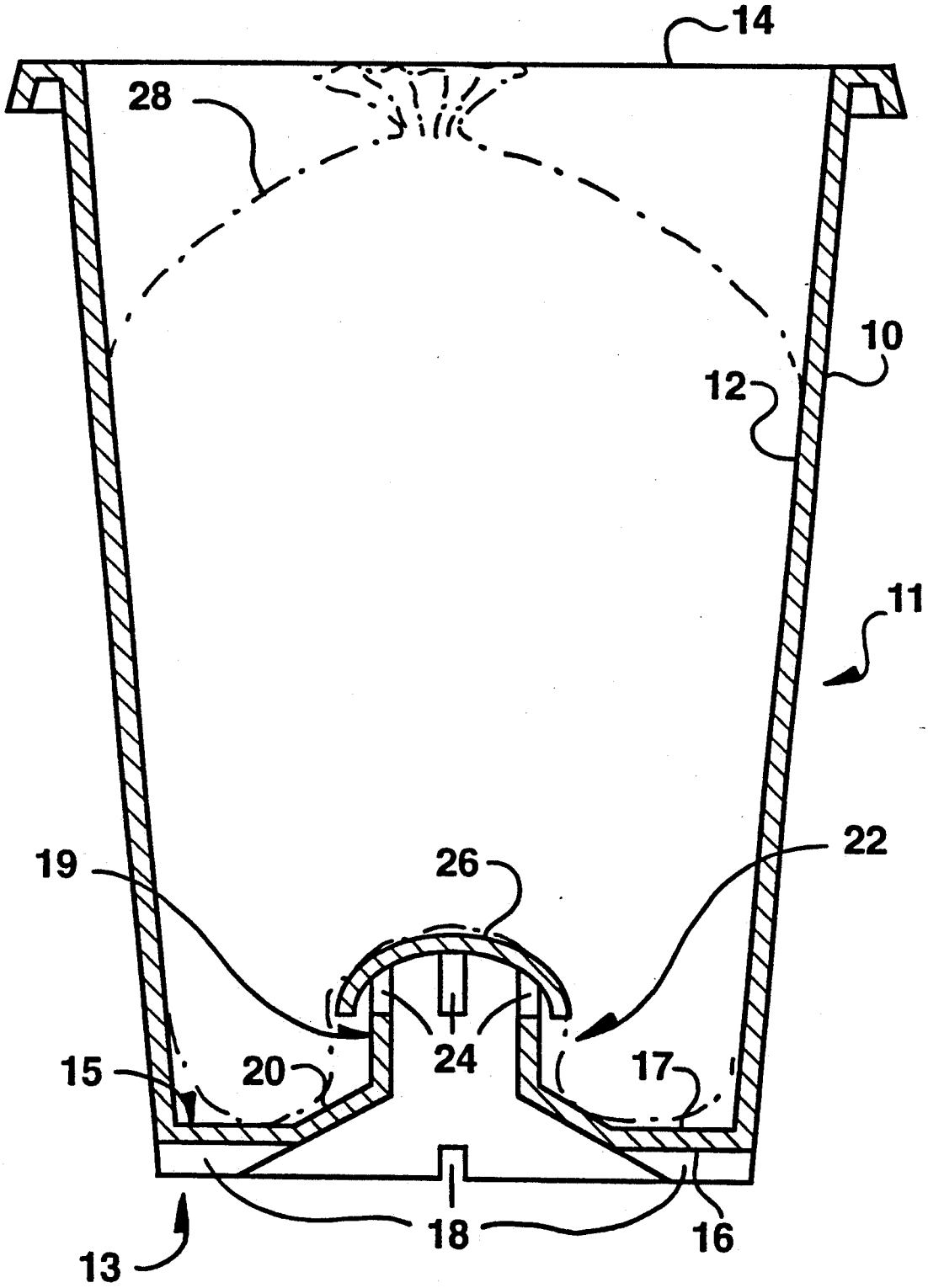
FIG. 1 is a sectional view of the essentially rigid receptacle through a vertical center plane. The venting means can be seen in the base area of the receptacle. The filled flexible bag liner is shown with a phantom line.

10 sidewall outer surface
11 sidewall
12 sidewall inside surface
13 sidewall
14 top opening
15 horizontally extending outer portion
16 basewall outer surface
17 basewall inner surface
18 air channel
19 vertical portion
20 sloped floor
22 vent stalk
24 vent holes
26 vent roof
28 flexible bag liner.

DETAILED DESCRIPTION OF THE INVENTION

FIG. 1 depicts an essentially rigid wall receptacle. The receptacle includes a rigid single sidewall 11 having an outer surface 10 and an inner surface 12. The sidewall 11 defines an open top 14 and a closed bottom forming a basewall 13. The open top 14 defines a diameter that is larger than the diameter defined by the basewall 13. The basewall 13 has an inner surface 17 and an outer surface 16, a portion of which seats on the floor and forms a horizontally extending outer portion 15. The inner portion of the basewall 13 further includes a vertically extending vent stalk 22. The vent stalk 22 is formed by a sloped floor 20 that slopes upwardly from the horizontally extending outer portion 15 to a vertical portion 19 that extends upwardly from the sloped floor 20. The sloped floor 20 diverts liquid to the horizontally extending outer portion 15 of the basewall 13. The vertical portion 19 includes a number of air vent holes 24 at its uppermost extent. Air from the outside the container is vented to the interior of the container by passing through air channels 18 formed in the horizontally extending outer portion 15 and sloped floor 20 of the basewall 13. The air flows up the vent stalk and enters the interior of the container through vent holes 24. The vertical vent stalk 22 has a domed-shaped vent roof 26 which provides a protective overhang.

Figure 2:
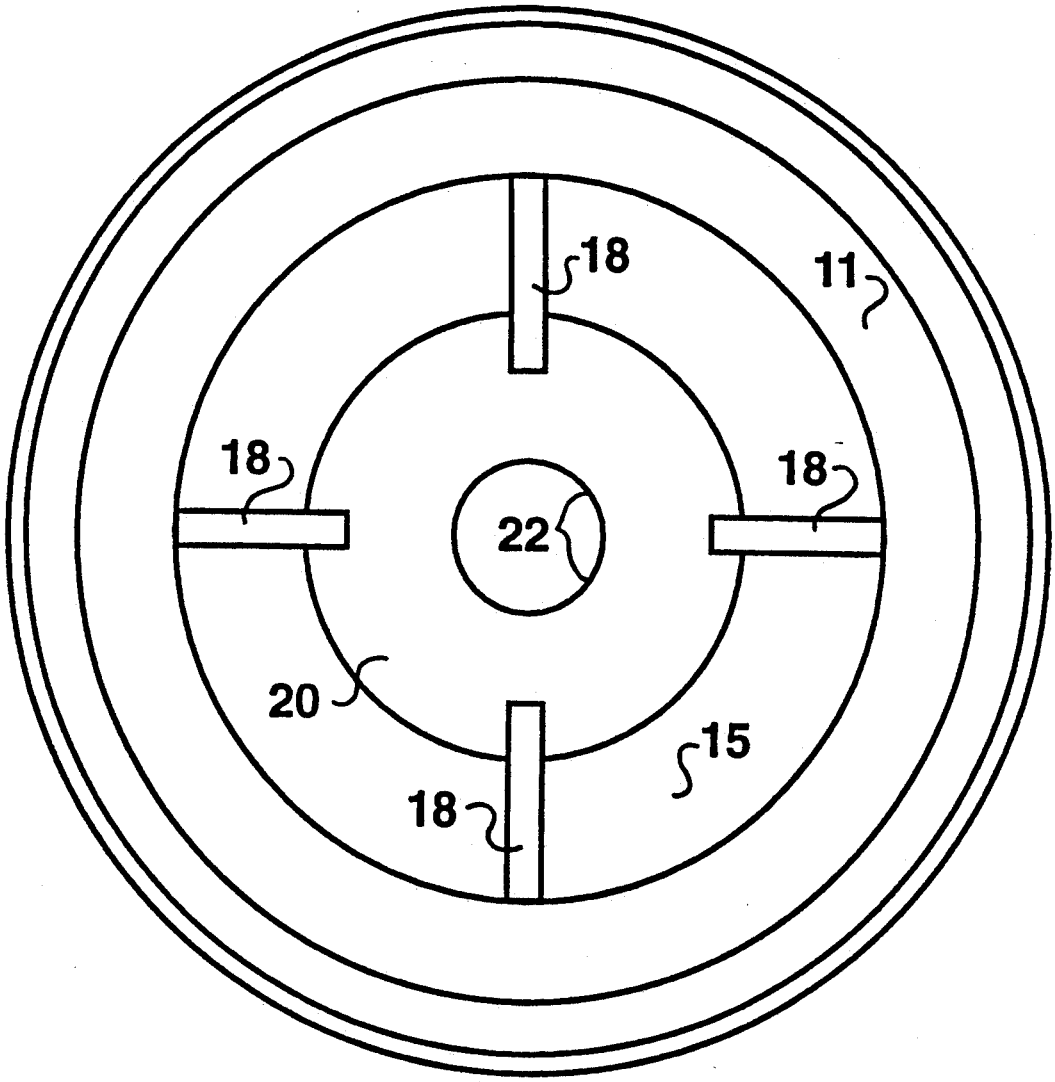
FIG. 2 is a view of the outside bottom of the receptacle.

FIG. 2 shows an outside view of the container bottom. The horizontally extending outer portion 15 is in the outer most area of the basewall 13. The horizontally extending outer portion 15 and sloped floor 20 of the basewall 13 will have one or more air channels surface 18 radiating from the vertical vent stalk 22.

USE AND OPERATION

In use, a flexible bag liner 28 is inserted into the open end of an essentially rigid wall container. The top opening 14 is wider than the closed bottom. As the flexible bag liner 28 is filled with refuse it becomes closely adapted to the container inner walls 12 and 17. The trapped air is vented to the outside atmosphere via the vent holes 24 and the air channels 18. Once filled with refuse, the filled flexible bag liner 28 is removed with a lifting force. Since the bottom of our container is vented with air vent holes 24; there is no effect of vacuum to overcome. Our research has shown that nonvented containers may require up to twenty five to thirty pounds of force to separate a filled flexible bag liner from the rigid host container. We might also add that our research has shown that containers with an active valve require an initial force of three to five pounds to activate the dormant valve. The final lifting force for all configurations is the weight of the filled bag of refuse.

Liquids which might spill or escape the flexible bag liner 28 can run off the dome shaped vent roof and spill onto the sloped floor 20. The roof overhang prevents liquid flow through the superiorly placed vent holes 24. The sloped floor 20 diverts the liquids away from the vertical vent stalk 22 and to the corners of the base inner surface 17. The sloped floor 20 is a preferred embodiment, not an essential configuration. A raised vent stalk with a flat floor would also confine spilled liquids.

In summary, there are no moving parts. There is no flapper valve, no plunger valve, no diaphragm, or no mushroom shaped valve. There is venting, and the basic function of the container to contain has not been negated.

Although the description above contains many specificities, these should not be construed as limiting the scope of the invention but as merely providing illustrations of some of the presently preferred embodiments of this invention. For example, the sloped floor could be extended to provide the function of the vent stalk. The the vent holes could be placed in depressions in the upper area of the sloped floor, the vent stalk omitted, and the vent roof attached directly to the sloped floor. Thus the scope of the invention should be determined by the appended claims and their legal equivalents, rather than by the examples given.

We claim:

1. A trash receptacle for allowing easy removal of a flexible bag liner comprising:

an essentially rigid container having a single sidewall defining an open top and a closed bottom, the sidewall having an outer surface and an inner surface, the closed bottom comprising a basewall including a horizontally extending outer portion and a vertically extending vent stalk inner portion, the vent stalk inner portion having a vertical portion extending upwardly from the horizontally extending outer portion towards the open top, the vertical portion including at least one vent hole at an upper end thereof, the horizontally extending outer portion of the basewall forming at least one air channel, the at least one air channel and the at least one vent hole cooperating to allow air to communicate between an exterior and an interior of the receptacle, and a domed-shaped vent roof overhanging and attached to the upper end of the vertically extending vent stalk inner portion.

2. The receptacle of claim 1 wherein a sloped floor slopes upwardly from the horizontally extending outer portion to the vertical portion, the sloped floor defining a portion of the at least one air channel.

3. The receptacle of claim 1 wherein the at least one vent hole comprises a plurality of vent holes.

4. The receptacle of claim 1 wherein the at least one air channel comprises a plurality of air channels.

5. The receptacle of claim 4 wherein the at least one vent hole comprises a plurality of vent holes.

* * * * *